US007213791B2

(12) United States Patent
Morris et al.

(10) Patent No.: US 7,213,791 B2
(45) Date of Patent: May 8, 2007

(54) BABY BOTTLE HOLDER FOR SELF-FEEDING

(76) Inventors: Edward Lee Morris, P.O. Box 206, Union, WV (US) 24983; Cherie Alexander, P.O. Box 206, Union, WV (US) 24983; Tyler Kress, 2312 Craig Cove Rd., Knoxville, TN (US) 37919

( * ) Notice: Subject to any disclaimer, the term of this patent is extended or adjusted under 35 U.S.C. 154(b) by 48 days.

(21) Appl. No.: 10/715,011

(22) Filed: Nov. 17, 2003

(65) Prior Publication Data

US 2004/0140407 A1 Jul. 22, 2004

Related U.S. Application Data

(60) Provisional application No. 60/427,591, filed on Nov. 19, 2002.

(51) Int. Cl.
*A61J 9/06* (2006.01)

(52) U.S. Cl. ..... 248/102; 248/205.2; 215/11.1; 215/399

(58) Field of Classification Search ..... 215/11.1, 215/11.6, 395, 399; 248/102, 105, 205.2, 248/103, 104; D24/195, 199
See application file for complete search history.

(56) References Cited

U.S. PATENT DOCUMENTS

| | | | | | |
|---|---|---|---|---|---|
| 784,914 | A * | 3/1905 | Boyle | 215/12.1 |
| 788,859 | A * | 5/1905 | Troy | 248/102 |
| 815,815 | A * | 3/1906 | Gregory | 248/102 |
| 2,199,869 | A * | 5/1940 | Baker et al. | 248/102 |
| 2,362,020 | A * | 11/1944 | Morrow | 248/102 |
| 2,631,288 | A * | 3/1953 | Daust | 2/49.3 |
| 2,637,515 | A * | 5/1953 | Walsh | 248/102 |
| 3,065,944 | A * | 11/1962 | Liebendorfer | 248/102 |
| 4,220,302 | A * | 9/1980 | Hampton et al. | 248/102 |
| 4,473,907 | A * | 10/1984 | Maillard | 2/48 |
| 4,630,793 | A * | 12/1986 | Hunter | 248/102 |
| 4,718,623 | A * | 1/1988 | McClure | 248/102 |
| 5,265,834 | A * | 11/1993 | Daniels | 248/104 |
| 5,873,551 | A * | 2/1999 | Jones | 248/102 |
| 5,927,661 | A * | 7/1999 | Tinsley et al. | 248/102 |
| 6,000,664 | A * | 12/1999 | Hood | 248/102 |
| 6,213,547 | B1 | 4/2001 | Bowe et al. | |
| 6,601,803 | B1 * | 8/2003 | Juranek | 248/102 |
| 2001/0002011 | A1 * | 5/2001 | Tebeau | 215/11.4 |

* cited by examiner

*Primary Examiner*—Sue A. Weaver
(74) *Attorney, Agent, or Firm*—Kathleen K. Bowen

(57) ABSTRACT

A baby bottle holder for baby self-feeding comprises an adjustable hanging mechanism; and, a bottle holding mechanism, attached to the adjustable hanging mechanism, such that when hung, a bottle inserted into the bottle holding mechanism hangs at an appropriate angle for feeding a baby positioned under the baby bottle holder. This baby bottle holder is made of a flexible material, and adjusts easily to fit on a variety of car seat/carrier/stroller handles, or other support.

2 Claims, 5 Drawing Sheets

BABY BOTTLE HOLDER FOR SELF-FEEDING

CROSS-REFERENCE TO RELATED APPLICATIONS

This application claims the benefit of U.S. Provisional Application No. 60/427,591, filed Nov. 19, 2002.

BACKGROUND

The present invention is in the field of baby bottle holders. Specifically this invention relates to adjustable holders for holding a baby bottle such that infants can feed themselves.

There are many baby bottle holders in the prior art, with the intention of allowing infants to feed themselves. Many of these use the method of propping up the bottle. There are also a few baby bottle holders which use the method of attaching the bottle holder to a car seat or a carrier handle. For example, U.S. Pat. No. 4,718,623 discloses a bottle sling, which holds the bottle, and has one strap with which it may be attached to a car seat. This design requires the baby to turn its head, it does not maintain a proper feeding angle, and it is not easily adjustable for different baby bottle sizes. U.S. Pat. No. 6,213,547 discloses a hanging adjustable baby bottle holder with two straps for attaching to a car seat handle. This design has a bar across the middle from which a ring is attached to hold the bottle. Hardware is used to secure the bottle, (a threaded bolt in the ring) which many people would not want in their infants face when the seat is moving. This design is also restricted to the unshaped carrying handle.

An adjustable baby bottle holder is desired which is of simple construction, and which would be adaptable to the many different types of carrying/stroller handles, or other support, which would adjust to any size bottle, which would hang at an appropriate feeding angle, which would return to position when knocked about by the infant, and which would be entirely flexible.

SUMMARY OF THE INVENTION

A baby bottle holder for baby self-feeding comprises an adjustable hanging means; and, a bottle holding means, attached to the adjustable hanging means, such that when hung, a bottle inserted into the bottle holding means hangs at an appropriate angle for feeding a baby positioned under the baby bottle holder. This baby bottle holder is made of a flexible material, and adjusts easily to fit on a variety of car seat/carrier/stroller handles, or other support.

DETAILED DESCRIPTION

Figure 1:
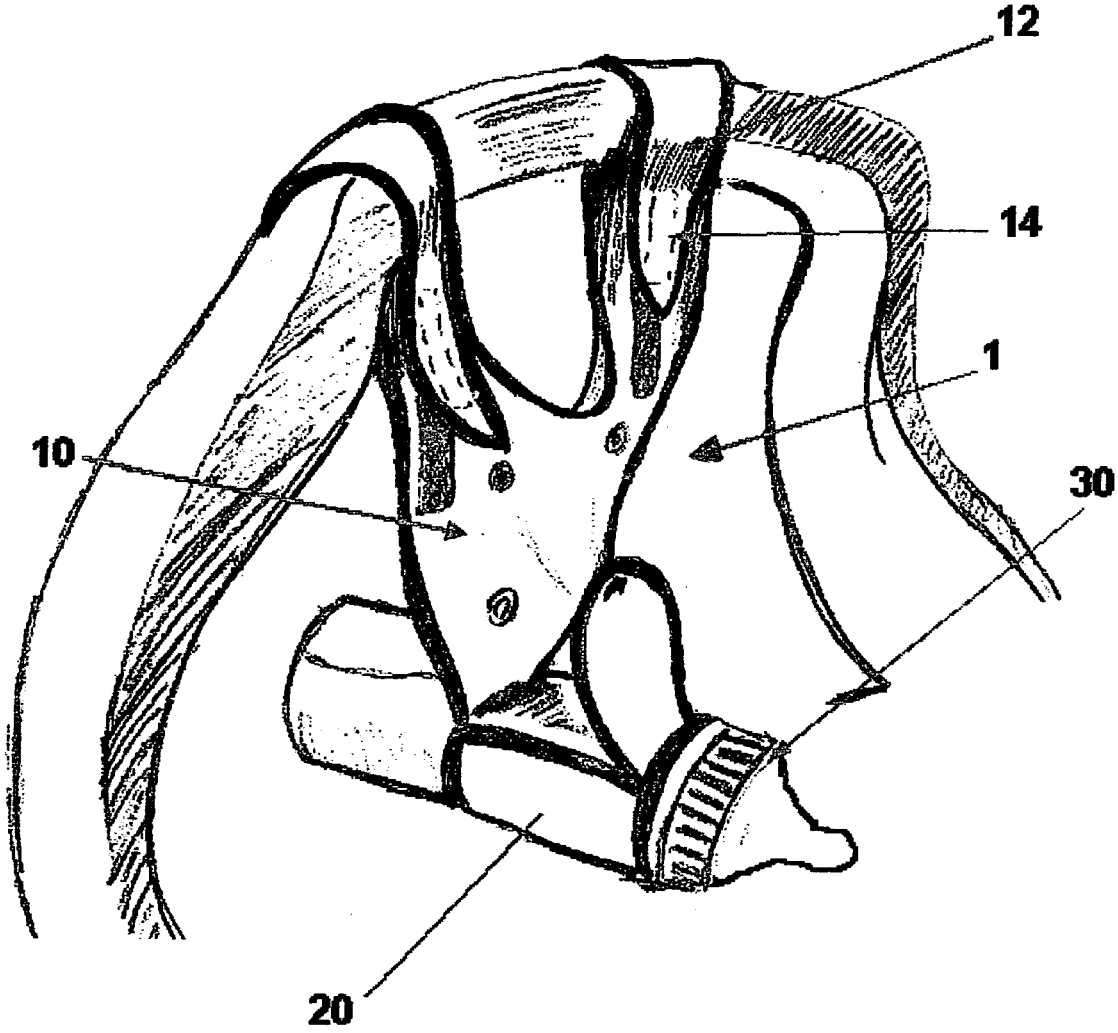
FIG. 1 is an isometric view of a baby bottle holder according to an aspect of the invention.
Figure 2:
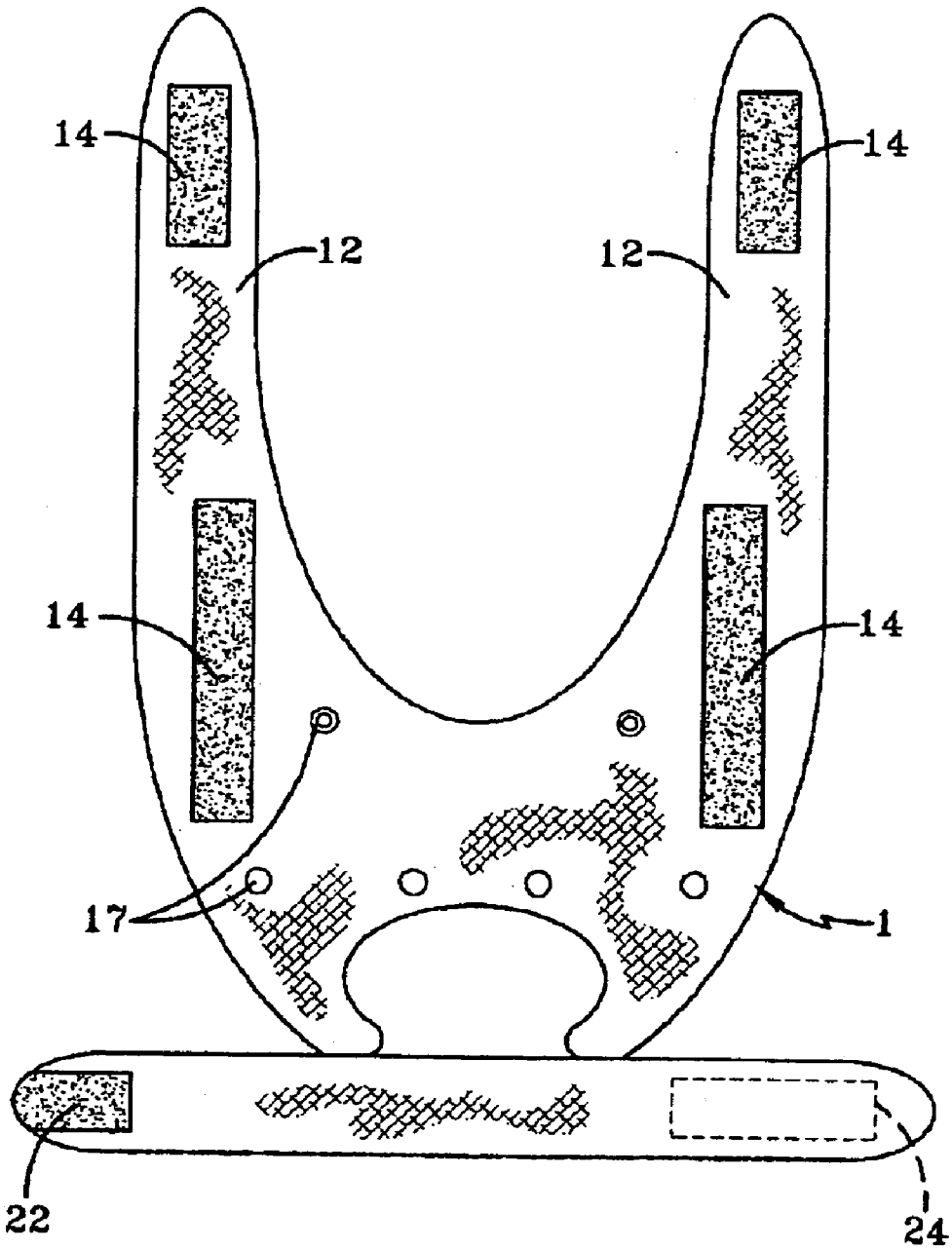
FIG. 2 is a front view of a baby bottle holder according to an aspect of the invention.
Figure 3:
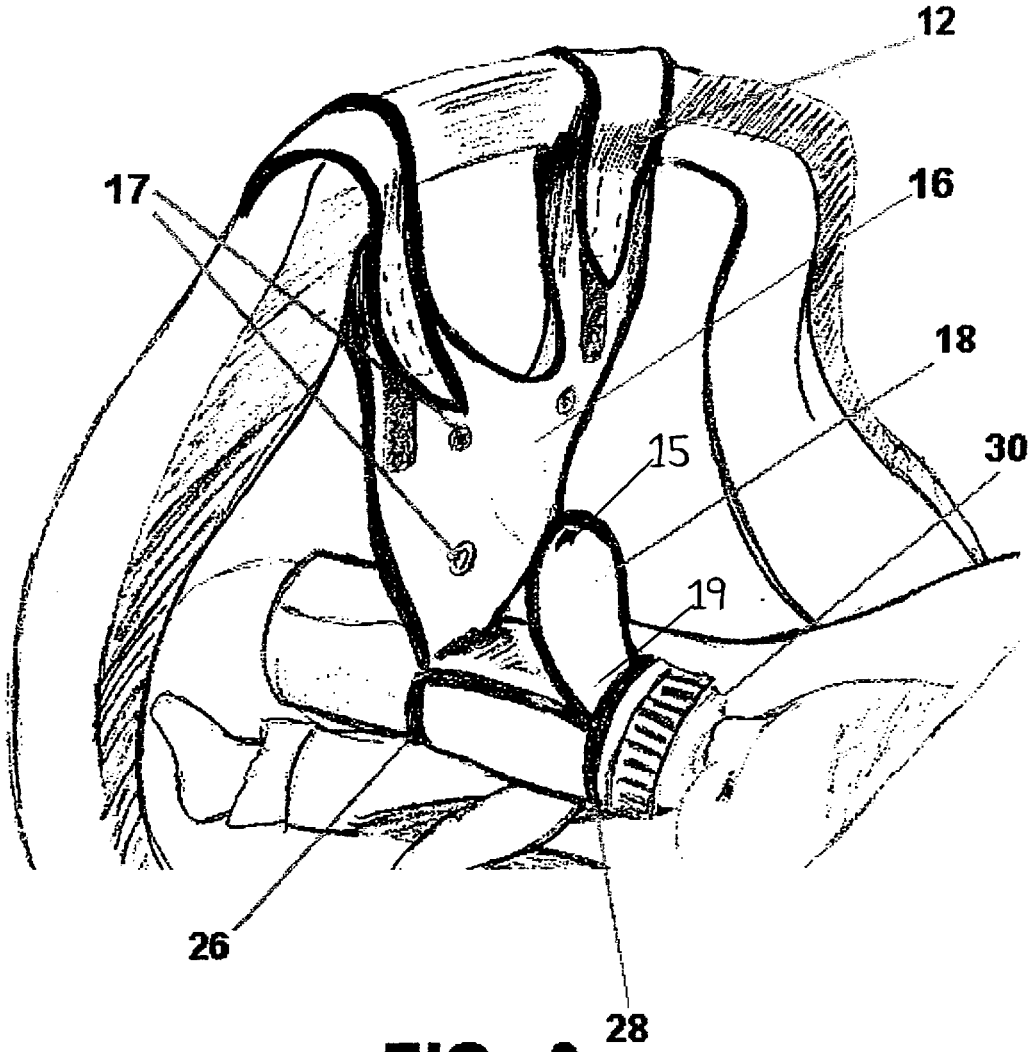
FIG. 3 is an isometric view of a baby bottle holder installed on a carrier with a U-shaped handle according to an aspect of the invention.
Figure 4:
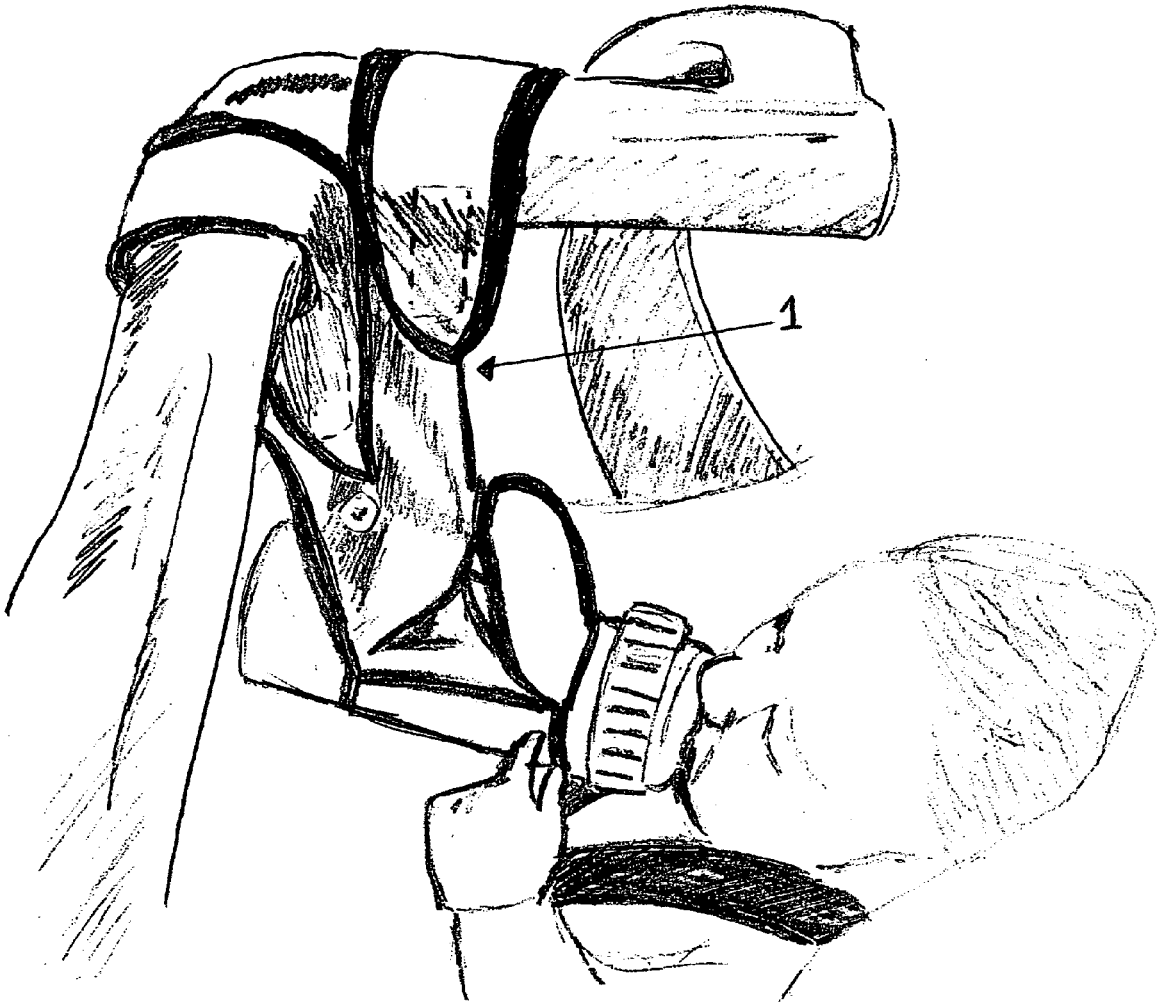
FIG. 4 is an isometric front view of a baby bottle holder installed on a carrier with a sideways handle according to an aspect of the invention.
Figure 5:
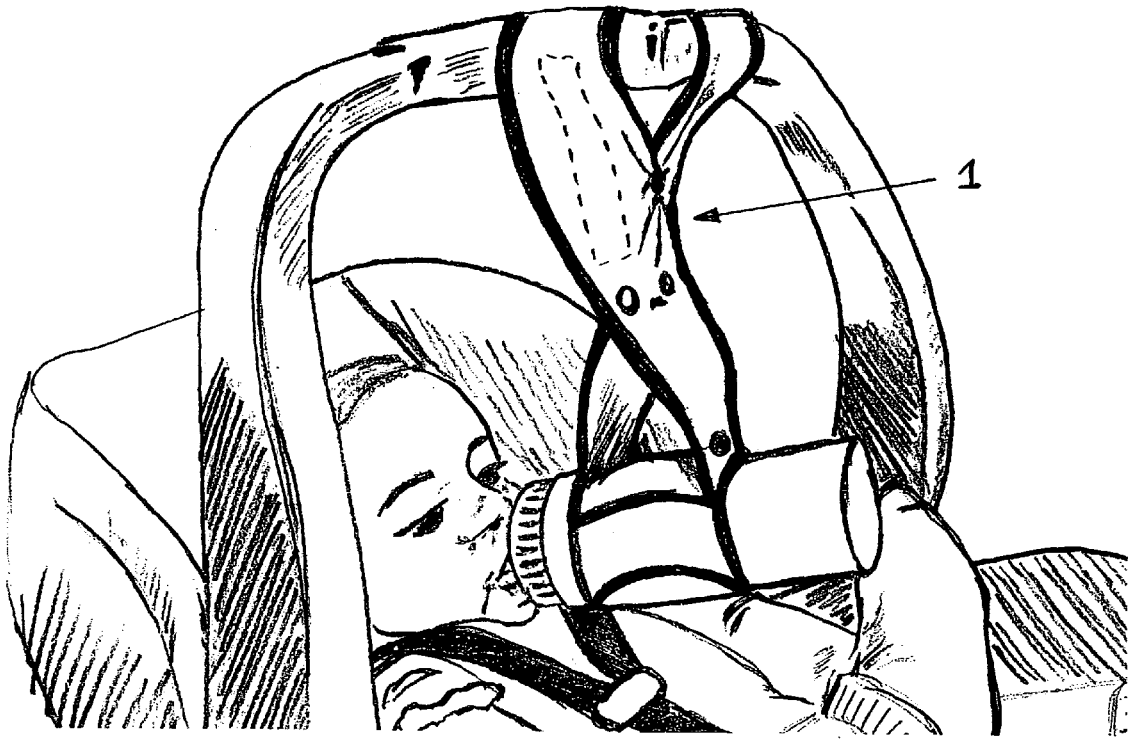
FIG. 5 is an isometric rear view of a baby bottle holder installed on a carrier with a sideways handle according to an aspect of the invention.

Various aspects of the invention are presented in FIGS. 1–5 which are not drawn to scale and in which like components are numbered alike. Referring now to FIGS. 1–3, according to an aspect of the invention, a baby bottle holder 1 for baby self-feeding comprises an adjustable hanging means 10, and a bottle holding means 20. The bottle holding means 20 is attached to the adjustable hanging means 10 such that when hung, a bottle 30 inserted into the bottle holding means 20 hangs at an appropriate angle for feeding a baby positioned under the baby bottle holder 1.

According to a further aspect of the invention, the adjustable hanging means 10 comprises straps 12 attachable by an adjustable fastener 14. In a preferred embodiment, the adjustable fastener 14 comprises a hook and loop fastener. One such hook and loop fastener which may be used is sold under the trademark Velcro. This is in no way intended to limit the adjustable fastener 14 to a hook and loop fastener, as any known adjustable fastener is within the purview of this invention. This not only allows adjustment for different types of carriers/car seats/strollers, or other supporting structures, but also allows for adjustment for different size infants.

In a preferred embodiment of the invention, the bottle holding means 20 is adjustable. According to a further preferred embodiment, the bottle holding means 20 is adjustable and comprises a bottle strap 22 with an adjustable closing means 24. One preferred adjustable closing means 24 is a hook and loop fastener. This is in no way intended to limit the adjustable closing means 24 to a hook and loop fastener, as any known adjustable closing means is within the purview of this invention. This allows for any type/shape of bottle to be held securely.

According to a further aspect of the invention, the adjustable hanging means 10 comprises straps 12 and a body portion 16, wherein the bottle holding means 20 is attached to the body portion 16. According to a preferred embodiment, the bottle holding means 20 has a bottom end 26 and a top end 28. In a preferred embodiment of the invention, the bottom end 26 of the bottle holding means 20 is attached directly to the body portion 16 of the adjustable hanging means 10, and the top end 28 of the bottle holding means 20 is attached to an extension 18 which in turn is attached to the body portion 16. According to a further aspect of the invention, this extension 18 is a piece of flexible material, such as a fabric, which has two ends, a first end 15 and a second end 19, wherein the first end 15 of the extension 18 is attached to the body portion 16, and the second end 19 of the extension 18 is attached to the bottle holding means 20. This allows the bottle 30 to be held in a position in which gravity forces the liquid contents into the nipple area of the bottle 30. Thus, even if the baby knocks the baby bottle holder 1 around, it will return to the baby at an appropriate angle for feeding.

In a further embodiment, the body portion 16 has a variety of fasteners 17 to further adjust the baby bottle holder 1. In a preferred embodiment of the invention, the fasteners 17 are snaps, although any known fastener is considered to be within the purview of the invention. The baby bottle holder 1 may be made of a flexible material, including, but not limited to, plastics, fabrics, and webbings. In a preferred embodiment, the adjustable hanging means 10 and the bottle holding means 20 are made from a fabric material. This flexibility allows the fasteners 17 to change the shape of the baby bottle holder 1 to adapt it to various carrier/stroller handle configurations. Thus it may be used for the standard u-shaped handle as well as for the sideways handle now used on some models (see FIG. 4 and FIG. 5), as well as on many other structures.

What is claimed is:

1. A baby bottle holder for baby self-feeding, comprising:

an adjustable hanging means for hanging a bottle, wherein said adjustable hanging means is capable of self-aligning the bottle over the baby, such that the baby may self-feed, unassisted by an adult, wherein said adjustable hanging means comprises straps and a body portion, wherein said bottle holding means is attached to said body portion; and, a bottle holding means, attached to said adjustable hanging means, such that when hung, a bottle inserted into said bottle holding means hangs at an appropriate angle for feeding a baby positioned under said baby bottle holder, wherein said bottle holding means has a bottom end and a top end, and wherein said bottom end of said bottle holding means is attached directly to said body portion of said adjustable hanging means, and said top end of said bottle holding means is attached to an extension which in turn is attached to said body portion.

2. The baby bottle holder of claim 1 wherein said extension is a piece of flexible material, which has two ends, a first end and a second end, wherein said first end of the extension is attached to said body portion, and said second end of the extension is attached to said bottle holding means.

* * * * *